US005988716A

United States Patent [19]

Liao

[11] Patent Number: 5,988,716

[45] Date of Patent: Nov. 23, 1999

[54] GOLF BALL PICKUP

[75] Inventor: Gordon Liao, Yung Kang, Taiwan

[73] Assignee: Unique Product & Design Co., Ltd., Tainen Hsien, Taiwan

[21] Appl. No.: 09/264,223

[22] Filed: Mar. 5, 1999

[51] Int. Cl.[6] ..... A63B 47/02

[52] U.S. Cl. ..... 294/19.2

[58] Field of Search ..... 294/19.1, 19.2; 56/328.1, 332; 221/65; 224/919; 285/298, 301, 302; 403/104, 109, 110, 374, 377

[56] References Cited

U.S. PATENT DOCUMENTS

| | | | |
|---|---|---|---|
| 2,203,170 | 6/1940 | Macdonald | 294/19.2 |
| 4,522,438 | 6/1985 | Logue | 294/19.2 |
| 4,629,235 | 12/1986 | Logue | 294/19.2 |
| 5,476,297 | 12/1995 | Lombard | 294/19.2 |

*Primary Examiner*—Johnny D. Cherry
*Attorney, Agent, or Firm*—Pro-Techtor International Services

[57] ABSTRACT

A golf ball pickup has a pickup tube consisting of an inner tube, an outer tube, a constrictor fixed on the inner tube, and a locking mechanism with an eccentric shaft. The outer tube has an engage mouth for the eccentric shaft to fit in. When the locking mechanism is swung from an unlocking condition to a locking condition, the eccentric shaft may press the inner tube immovable. The eccentric shaft has one end functioning to stop the constrictor and then the inner tube in telescoping in the outer tube, without possibility of the inner tube completely sliding out of the outer tube. Thus the golf ball pickup has function of lengthening and shortening with non-stage to collapse to a small dimension for saving cost of package and transportation, and of suitting to golfers of different height to use.

4 Claims, 9 Drawing Sheets

GOLF BALL PICKUP

BACKGROUND OF THE INVENTION

This invention relates to a golf ball pickup, particularly to one having a pickup tube adjustable non-stage in its length to be collapsed to a small dimension to save expenditure for its package and transportation and to suit to golfers of different height.

A known conventional golf ball pickup shown in FIGS. 1 and 2, includes a pickup tube 1 and a ball bag 2 as main components.

The pickup tube 1 has a sleeve 10 fixed with a lower end of the tube body, a plurality of elastic hooks 11 fixed spaced apart on a lower inner end surface of the sleeve 10, and an upper portion extending in the ball bag 2. Further, two fixing members 12 are fixed between an upper end of the pickup tube 1 and a grip 20 located outside of an upper side of the ball bag 2.

The ball bag 2 has a zipper mouth 21 in one side for taking out golf balls stored therein, an upper side board 22 and a lower side board 23 for expanding an inner space of the ball bag 2.

In picking up a golf ball from the ground with the conventional golf ball pickup, a user holds the grip 20 and pushes on a golf ball with the lower end of the sleeve 10 of pickup tube 1, with the ball to be pinched by the elastic hooks 11 to stay in the sleeve 10. Then the user picks up another golf ball to push up the lowest ball in the sleeve 10 one by one to finally enter the ball bag 2, and to be stored therein.

However, though the known conventional golf ball pickup has function of picking up and storing golf balls, it has the pickup tube 1 of a definite length, unable to be collapsed and thus also unable to suit to golfers of different height, inconvenient for package or transportation, resulting in not competitive in market.

SUMMARY OF THE INVENTION

A purpose of the invention is to offer a golf ball pickup improved in the drawbacks of the known conventtional golf ball pickup mentioned above, able to be collapsed to a small dimension by an inner tube telescoped in an outer tube so as to suit to golfers of different height and to save cost for package and transportation as well.

The feature of the invention is a pickup tube consisting of an inner tube and an outer tube for the inner tube to telescope in a non-stage way in the outer tube to adjust the length of the pickup tube, and then the inner tube can be secured at one of many positions by means of a locking means. The outer tube has an engage mouth in a lower end for the bottom of an eccentric shaft of the locking means to fit in so that the eccentric shaft may press the outer surface of the inner tube to secure the inner tube immovable at one of many positions adjusted when the locking means is pushed to a locking position. When the locking means is not pushed to the locking position, the eccentric shaft can stop a constrictor engaging in the inner tube, enabling the inner tube to telescope in the outer tube without possibility of completely sliding out of the outer tube. Thus, the golf ball pickup in the invention can be collapsed to a small dimension, saving cost of package and transportation, and functioning to suit to golfers of different height as well.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
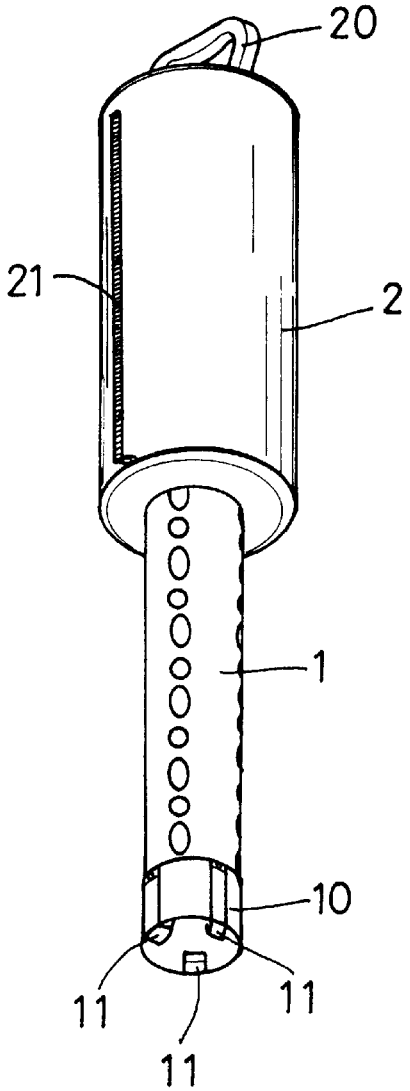
FIG. 1 is a perspective view of a known conventional golf ball pickup.
Figure 2:
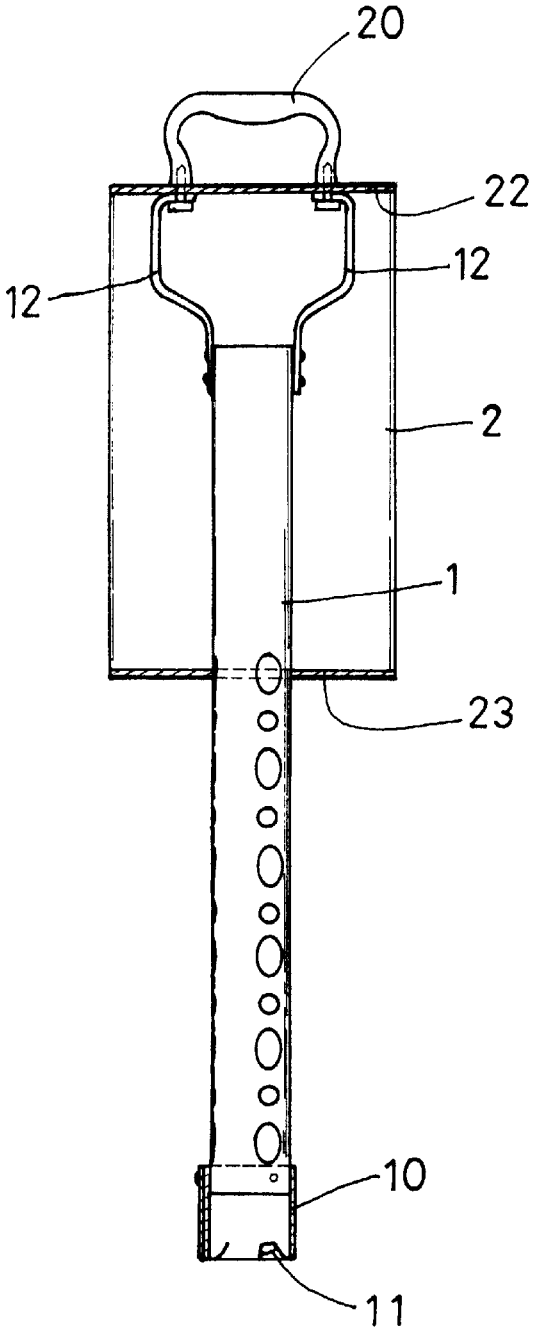
FIG. 2 is a cross-sectional view of the known conventional golf ball pickup.
Figure 3:
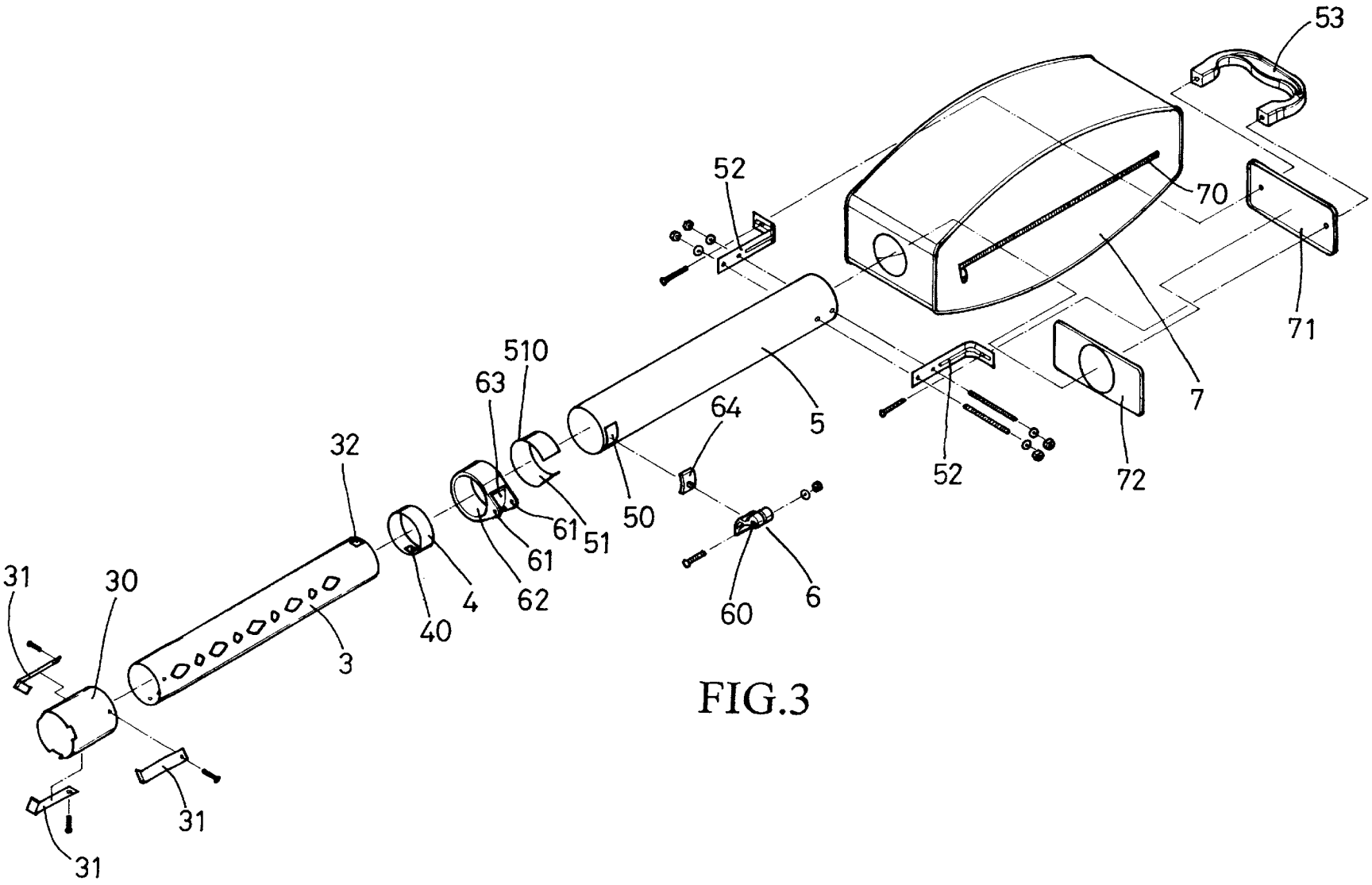
FIG. 3 is an exploded perspective view of a golf ball pickup in the present invention.

A preferred embodiment of a golf ball pickup in the present invention, as shown in FIG. 3, includes a pickup tube consisting of an inner tube 3 and an outer tube 5 for the inner tube 3 to telescope therein, a constrictor 4 fitting around an upper end of the inner tribe 3, a locking means 6 fixed on a lower end of the outer tube 5 and having an eccentric shaft 60, and a ball bag 7 as main components combined together.

The inner tube 3 has an engage notch 32 in an upper end and a sleeve 30 fixed around a lower end and provided with a plurality of elastic hooks 31 fixed and spaced apart in a lower inner surface.

The constrictor 4 is a ring, having a projection 40 on an inner surface to engage with the engage notch 32 of the inner tube 3 to secure the constrictor 4 with the inner tube 3 so as to move together.

The outer tube 5 has an engage mouth 50 in a lower end, a C-shaped ring 51 fitted in an inner side and having an engage lip 510 formed in a lower end edge to engage the lower end edge of the outer tube 5 to secure the ring 51 with the outer tube 5. Further, the outer tube 5 extends in the ball bag 7, having two opposite L-shaped fix members 52 fixed on an outer wall of the upper end with bolts and nuts and connected to the grip 53 as well.

Figure 8:
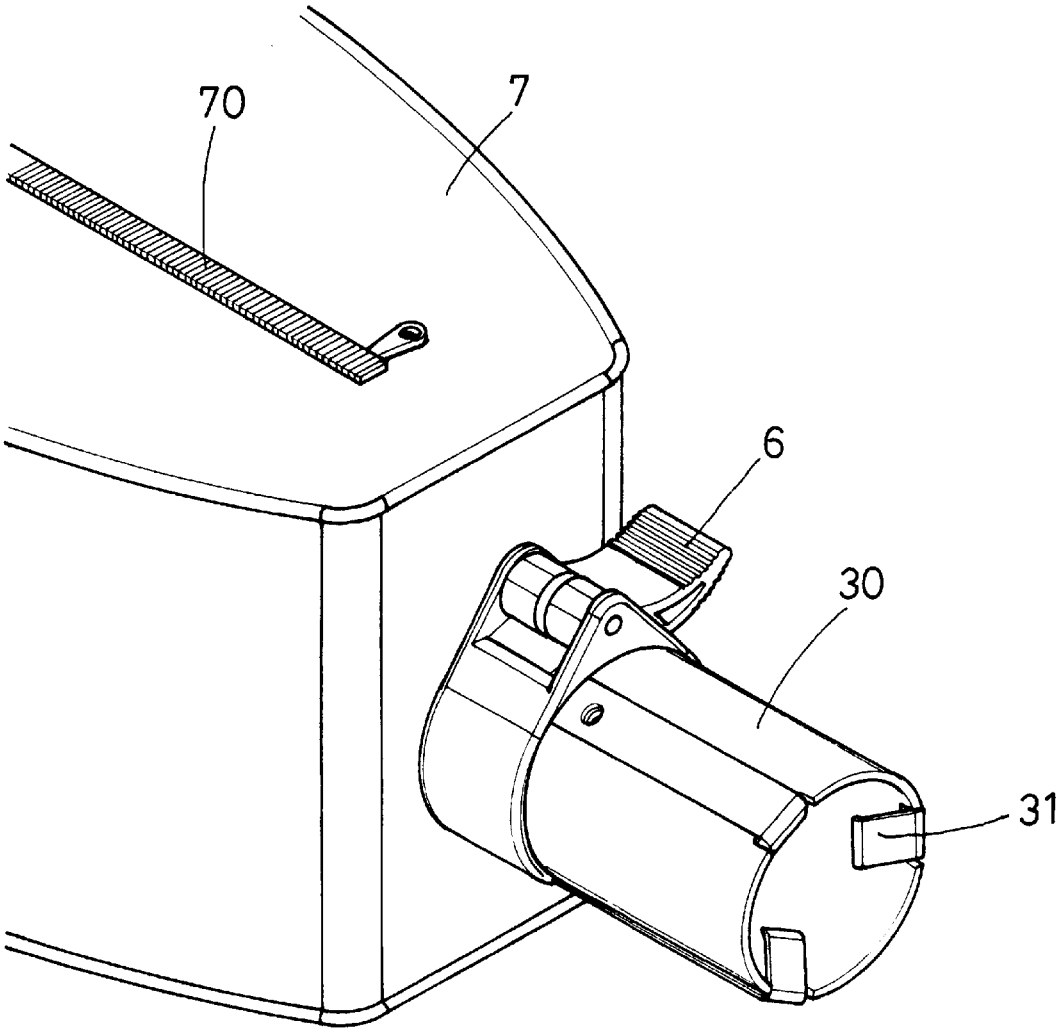
FIG. 8 is a perspective view of the golf ball pickup in the collapsed and locked condition in the present invention.
Figure 11:
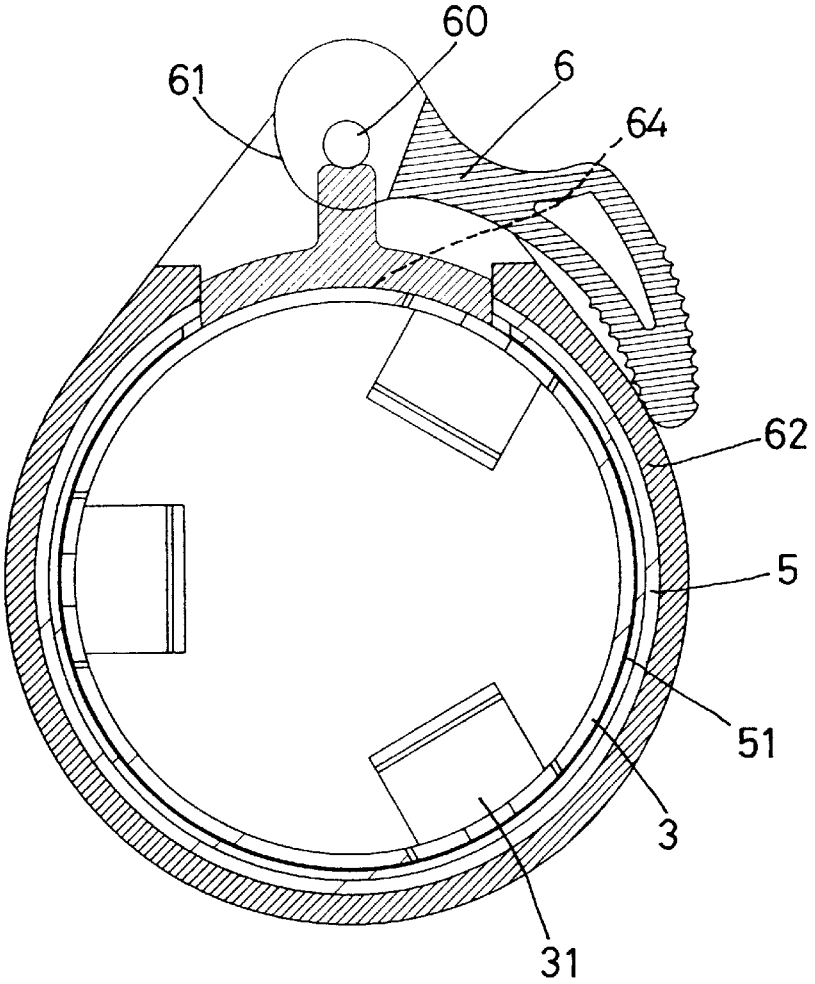
FIG. 11 is a cross-sectional view of the golf ball pickup in the collapsed but unlocked condition in the present invention.
Figure 9:
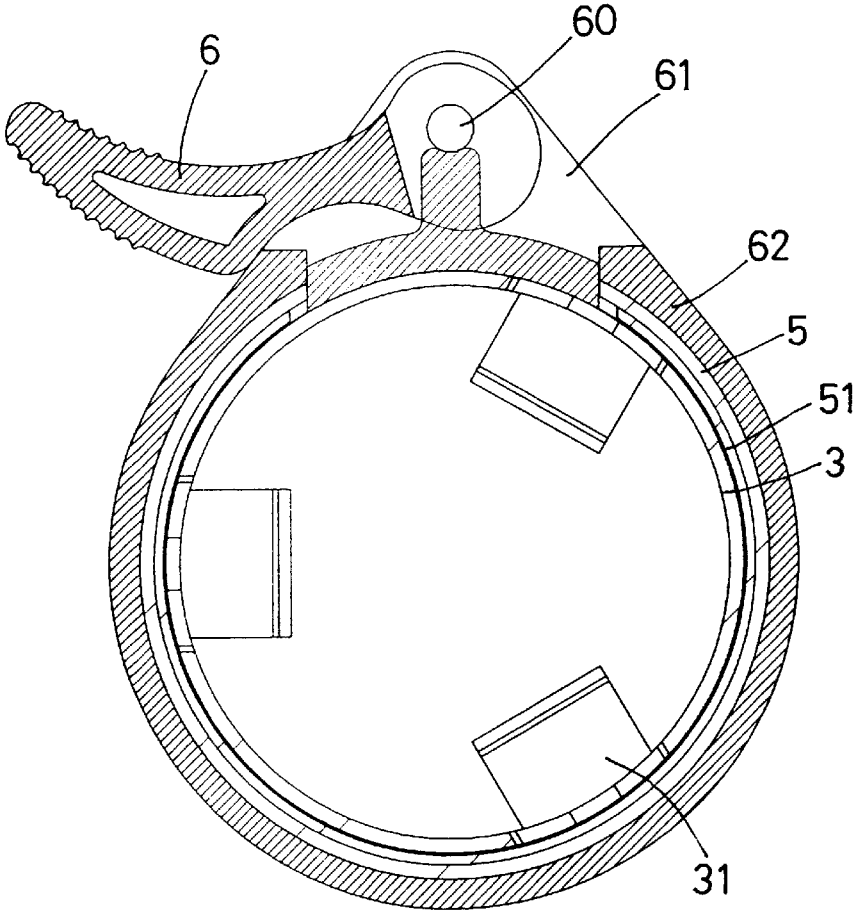
FIG. 9 is a cross-sectional view of the golf ball pickup in the collapsed and locked condition in the present invention.
Figure 10:
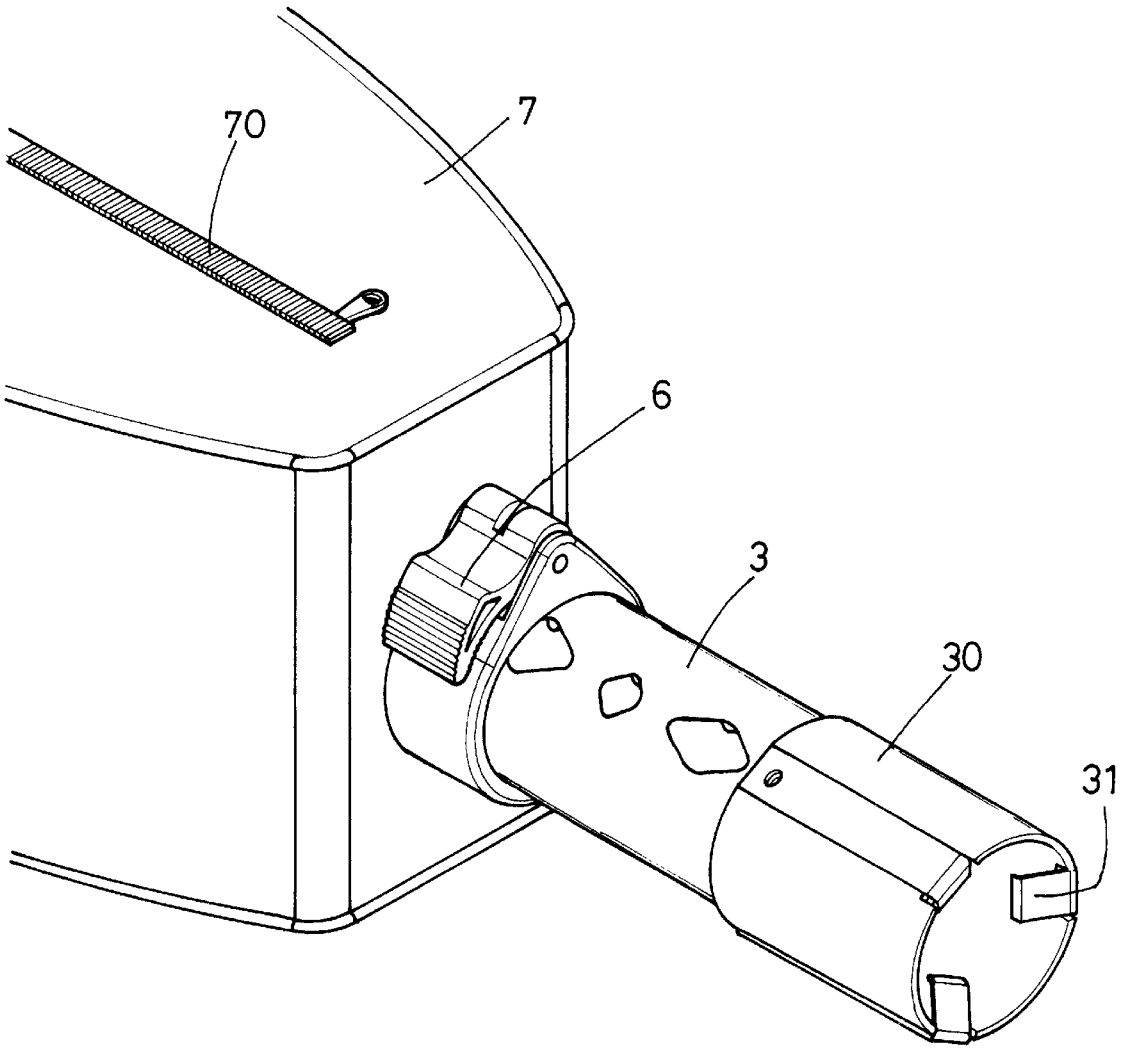
FIG. 10 is a perspective view of the golf ball pickup in the collapsed but unlocked condition in the present invention.
Figure 12:
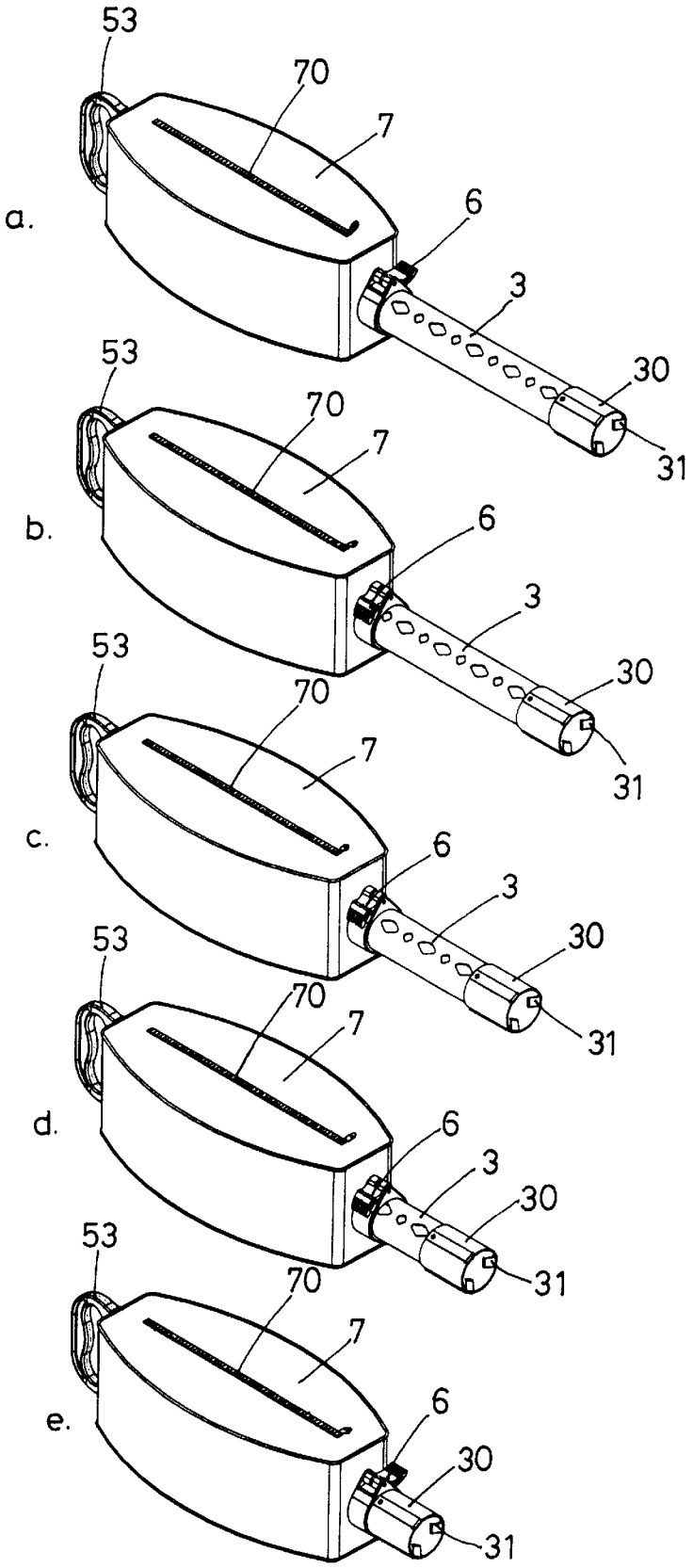
FIGS. 12*a*–12*e* are perspective views of the non-stage length adjusting action in the golf ball pickup in the present invention; and, FIG. 13 is a cross-sectional view of a second embodiment of a locking means in the golf ball pickup in the present invention.

The locking means 6 has an eccentric shaft 60 pivotally connected with two ears 61 of a pivotal ring 62 fixed around the outer tube 5, as shown in FIGS. 8 and 10, enabling the locking means 6 to swing to the right side for unlocking or from the right side to the left side for locking (as seen in FIGS. 9 and 11. The pivotal ring 62 has an aperture 63 between the two ears 61 to face the engage mouth 50 of the outer tube 5 for a position means 64 to fit in the mouth 50 and the aperture 63 to secure the pivotal ring 62 immovable. Further the position means 64 has its upper surface compressed by the bottom of the eccentric shaft 60 and pressing indirectly the inner tube 3 to secure the inner tube 3 to the outer tube 5 immovable at one of many positions after the inner tube 3 is telescoped in and out of the outer tube 5 for adjusting the whole length of the pickup tube.

The ball bag 7 has a zipper 70 provided in one side for opening to take out balls stored therein, an upper board 71 fixed on an upper end and a lower board 72 on the lower end of the outer tube 5 for expanding the space of the ball bag 7 and reinforcing the ball bag 7 as well.

Figure 5:
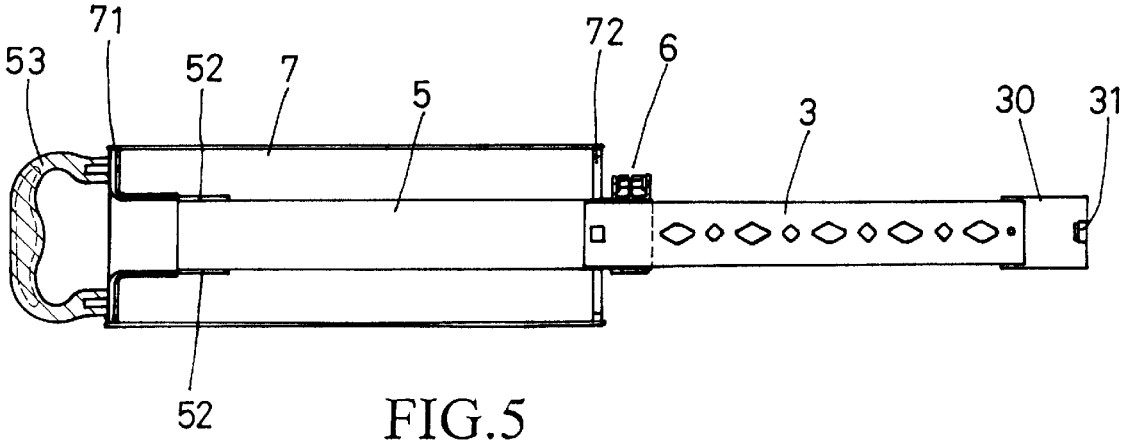
FIG. 5 is a cross-sectional view of the golf ball pickup in the present invention.
Figure 4:
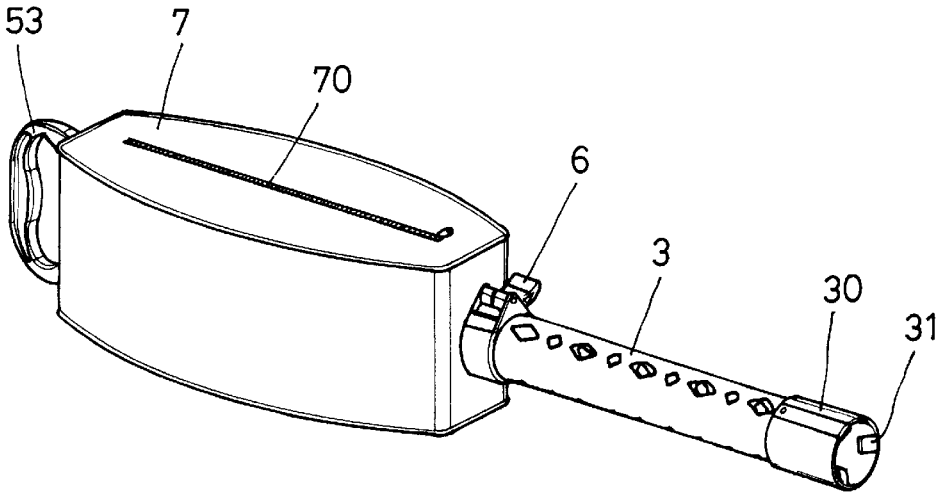
FIG. 4 is a perspective view of the golf ball pickup in the present invention.

FIGS. 4 and 5 show the golf ball pickup completely assembled together, with the outer tube 5 located in the ball bag 7 and the inner tube 3 exposed out of the ball bag 7. And the locking means 6 is in a locking position wherein the inner tube 3 is locked immovable to the outer tube 5, with FIG. 9 also referred to, wherein the eccentric shaft 60 has its bottom pressing the position means 64, which then presses the inner tube 3 so that the inner tube may be impossible to telescope in or out of the outer tube 5.

Figure 7:
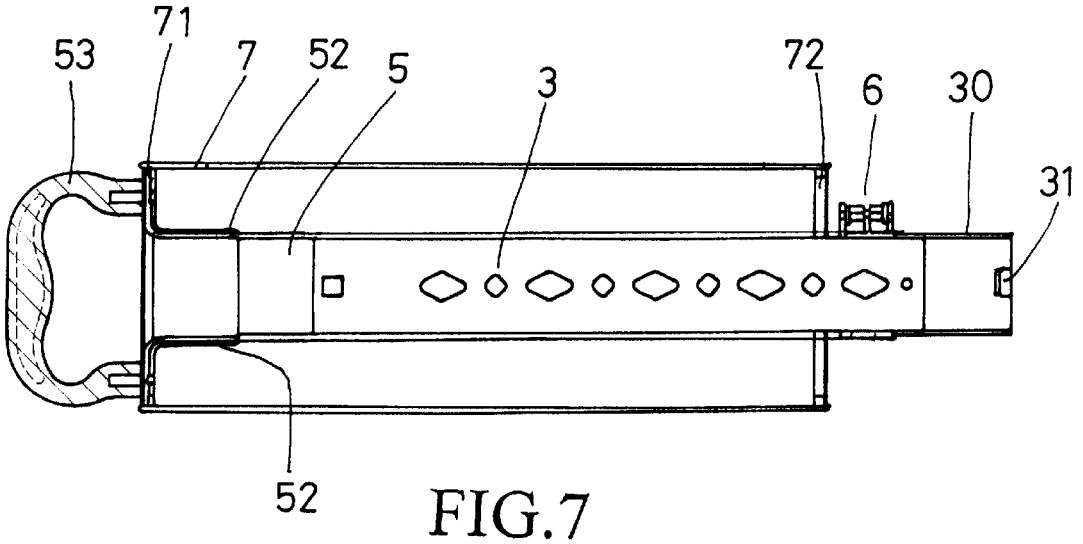
FIG. 7 is a cross-sectional view of the golf ball pickup in the collapsed condition in the present invention.
Figure 6:
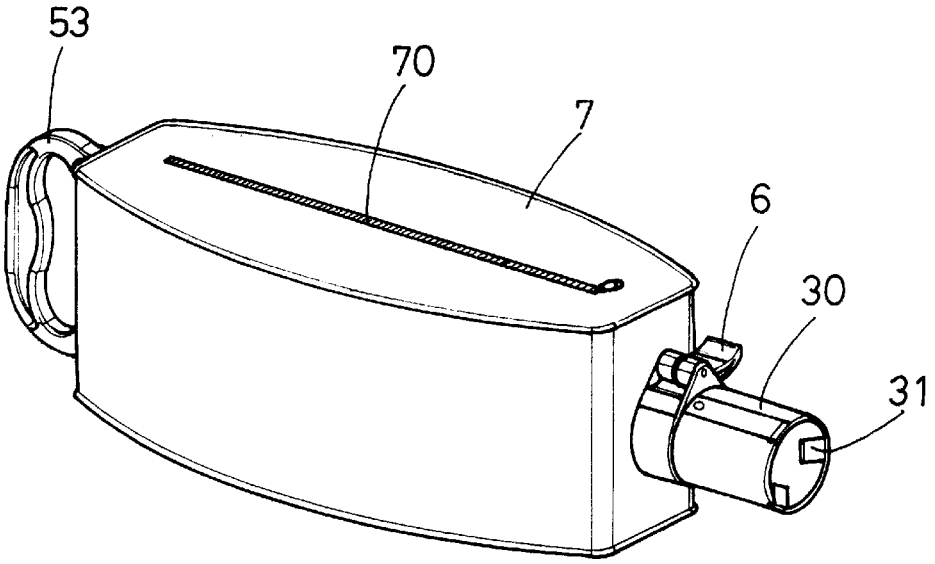
FIG. 6 is a perspective view of the golf ball pickup in the collapsed condition in the present invention.

In case that the inner tube 3 is to be adjusted in its length relative to the outer tube 5, referring to FIGS. 10 and 11, the locking means 6 is pulled to swing from the locking position shown in FIG. 11 to the unlocking position shown in FIG. 10. Then the eccentric shaft 60 no longer presses the position means 64, which then does not press the inner tube 3, permitting the inner tube 3 to telescope in or out of the outer tube 5 to one of many positions, or in other words, able to be adjusted to one of many positions in a non-stage way as shown in FIGS. 12*a*–12*e*. The position means 64 has its one end having a stop function, and the inner tube 3 and the constrictor 4 extend in the outer tube 5, surpassing the position means 64. So the inner tube 3 may not wholly slide out of the outer tube 5 in telescoping stopped by the position means 64, even if the locking means 6 should be in the unlocking condition. So when the inner tube 3 is telescoped to the collapsed unlocked condition as shown in FIG. 6, a user can swing lightly the locking means 6 to the locking condition shown in FIGS. 7 and 8, wherein the inner tube 3 is locked immovable.

Figure 13:
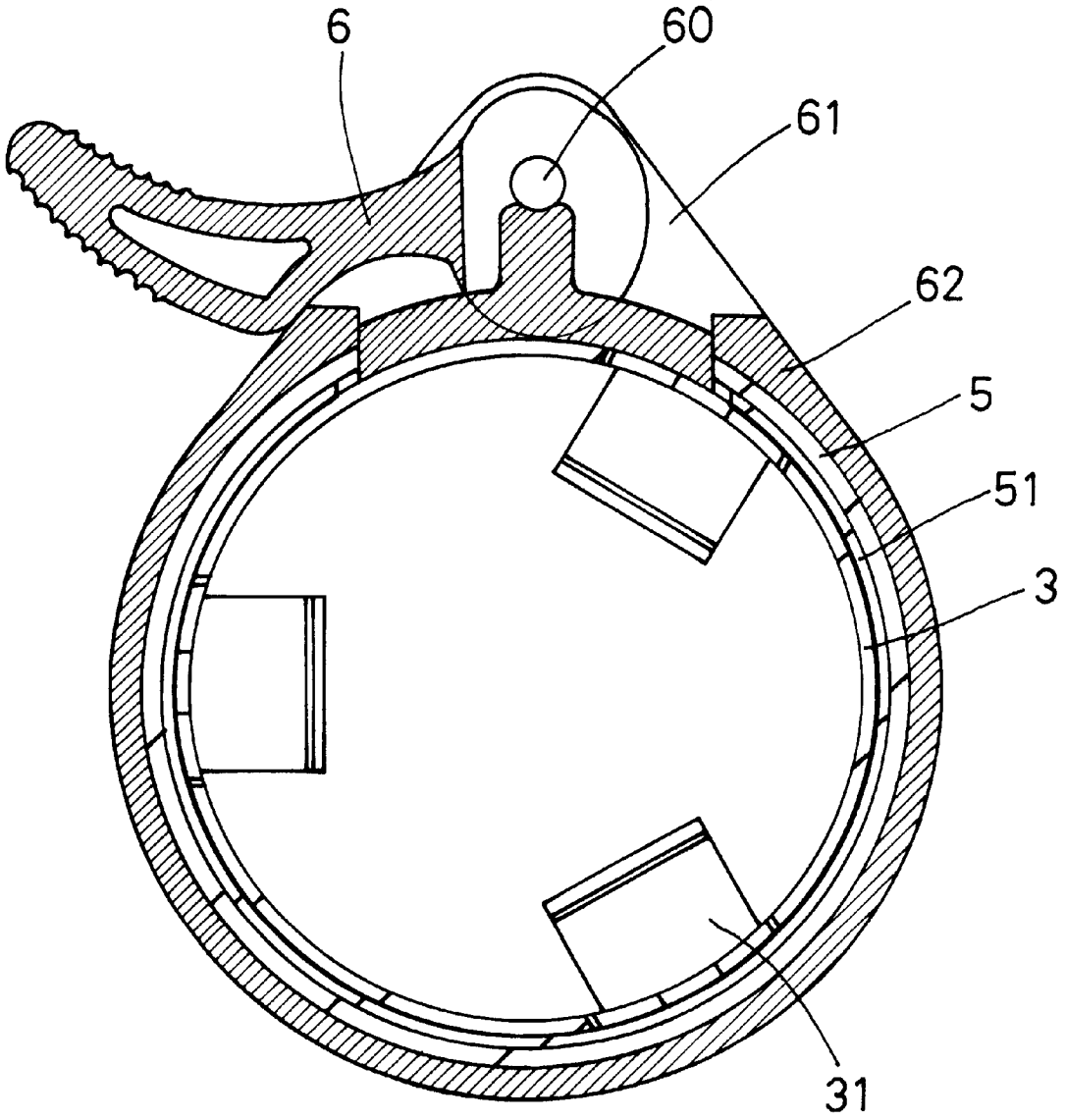

Further, FIG. 13 shows a second embodiment of a locking means of the inner tube 3. The basic idea of the present invention is not that the position means 64 must be used for telescoping and positioning the inner tube 3, and neither the C-shaped ring 51, the position means 64 or the pivotal ring 62 is necessary. It is only an example for a preferred embodiment, not limited in those components. The locking means 6 can be directly connected pivotally with the outer tube 5, with the eccentric shaft 60 having its bottom size being the same as the engage mouth 50, and then the bottom can directly press the inner tube 3 to secure it stabilized, in the same way as in the above embodiment.

The golf ball pickup in the invention has the following advantages, compared with the known conventional one.

1. It has an effect of non-stage adjustment in the length of the inner tube, but the conventional one has its ball picking up tube 1 of a definite length impossible to lengthen or shrink in its length. But the inner tube 3, as shown in FIGS. 12*a*–12*e*, can be extended or shrunk to any position with non-stage. So the present invention can suit to any golfer with different height, very convenient, but the conventional one is limited to a person with a special height.

2. The conventional one has a large dimension to cost much in package and transportation, but the present invention can be collapsed to a small dimension, resulting in saving cost in package and transportation, having worthiness to be utilized in industry and effect of lowering cost.

3. The present invention has the ball pickup tube (the inner tube 3) extensible and collapsible, having more components than the conventional one. But their structures are not complicated, easy to assemble, simple to adjust the length of the inner tube 3, provided with practicability.

While the preferred embodiment of the invention has been described above, it will be recognized and understood that various modifications may be made therein and the appended claims are intended to cover all such modifications which may fall within the spirit and scope of the invention.

I claim:

1. A golf ball pickup comprising:

a pickup tube having a lower end having a function of picking up a golf ball and an upper end extending in a ball bag, and fixed with a grip deposited on an outer side of said bag;

said ball bag having an aperture for taking out golf balls; and, characterized by said pickup tube consisting of an inner tube, a ring constrictor positioned around an outer surface of said inner tube, an outer tube for said said inner tube with said constrictor to telescope therein, and a locking means having an eccentric shaft positioned on said outer tube, said outer tube having an engage mouth formed in a lower end to face said eccentric shaft for a bottom of said eccentric shaft to fit in, said eccentric shaft having its bottom pressing said inner tube when said locking means is swung from an unlocking position wherein said inner tube is movable to a locking position wherein said inner tube is immovable so that said inner tube may be secured immovable at one of many positions after said inner tube is telescoped to said position relative to said outer tube; said eccentric shaft having its one end functioning to stop said constrictor located in said inner tube when said locking means is not in the locking position, said inner tube freely telescoping in said outer tube without possibility of wholly sliding out of said outer tube by means of said eccentric shaft stopping said constrictor, thus said golf ball pickup being able to be collapsed to a small dimension for saving cost for package and transportation and suiting golfers of different height in using it for picking up golf balls.

2. The golf ball pickup as claimed in claim 1, wherein said constrictor is a ring having an engaging projection formed in an inner surface, and said inner tube has an engage notch formed in an upper end for fixing said constrictor.

3. The golf ball pickup as claimed in claim 1, wherein a pivotal ring is fixed around said outer tube, having two ears standing upright for installing said eccentric shaft of said locking means, and a notch formed between said two ears to correspond to said engage mouth of said outer tube.

4. The golf ball pickup as claimed in claim 1, wherein a position means is provided to fit in said engage mouth of said outer tube for said locking means to press so that said position means may then press said inner tube immovable in one of many positions relative to said outer tube.

* * * * *